US005489755A

United States Patent [19]

Castonguay et al.

[11] Patent Number: 5,489,755

[45] Date of Patent: Feb. 6, 1996

[54] HANDLE OPERATOR ASSEMBLY FOR HIGH AMPERE-RATED CIRCUIT BREAKER

[75] Inventors: Roger N. Castonguay, Terryville; James L. Rosen, West Hartford; Mark A. Zaffetti, Windsor Locks; Thomas A. Murphy, Southington, all of Conn.

[73] Assignee: General Electric Company, New York, N.Y.

[21] Appl. No.: 214,522

[22] Filed: Mar. 18, 1994

[51] Int. Cl.[6] ..... H01H 3/46

[52] U.S. Cl. ..... 200/400

[58] Field of Search ..... 200/400

[56] References Cited

U.S. PATENT DOCUMENTS

| | | | |
|---|---|---|---|
| 2,581,181 | 1/1952 | Favre . | |
| 4,001,742 | 1/1977 | Jencks et al. . | |
| 4,801,907 | 1/1989 | Kelaita, Jr. et al. . | |
| 4,888,458 | 12/1989 | Suzuyama et al. | 200/400 |
| 5,004,875 | 4/1991 | Moody et al. | 200/400 |
| 5,113,056 | 5/1992 | Kuhn | 200/400 |
| 5,148,913 | 9/1992 | Bonnardel et al. | 200/400 |
| 5,274,206 | 12/1993 | Milianowicz | 200/400 |

*Primary Examiner*—Renee S. Luebke
*Attorney, Agent, or Firm*—Richard A. Menelly

[57] ABSTRACT

This invention relates to a high ampere-rated circuit breaker which meets the electrical code requirements of the world market. The charging of the powerful operating springs controlling the circuit breaker contacts is made manually by means of an externally accessible handle operator assembly. A ratchet and pawl assembly allows the application of a large spring charging force by virtue of a short displacement of the handle operator.

1 Claim, 4 Drawing Sheets

HANDLE OPERATOR ASSEMBLY FOR HIGH AMPERE-RATED CIRCUIT BREAKER

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140, filed Feb. 25 1994 entitled "Operating Mechanism for High Ampre-Rated Circuit Breaker", describes an operating mechanism capable of immediately resetting the circuit breaker operating mechanism to reclose the contacts without having to recharge the circuit breaker operating springs immediately after opening the circuit breaker contacts.

U.S. patent application Ser. No. 08/203,062 filed Feb. 22, 1994 entitled "Rating Module Unit for High Ampre-Rated Circuit Breaker", describes a circuit breaker closing spring modular unit whereby the circuit breaker operating springs are contained within a separate unit from the operating mechanism and can be installed within the circuit breaker enclosure without disturbing the operating mechanism assembly.

The circuit breaker operating springs can be recharged by means of a motor operator or by means a manually-accessible handle operator unit.

The purpose of this invention is to provide a handle operator unit capable of generating large spring charging forces by means of an externally-accessible manually operated handle.

SUMMARY OF THE INVENTION

The circuit breaker operating mechanism operating springs are charged by means of an externally accessible handle that includes a handle drive gear and pawl assembly. The handle drive gear includes an array of charging teeth and a separate array of stopping teeth to provide a large spring charging force with a relatively short displacement of the handle.

DESCRIPTION OF THE PREFERRED EMBODIMENT

Figure 1:
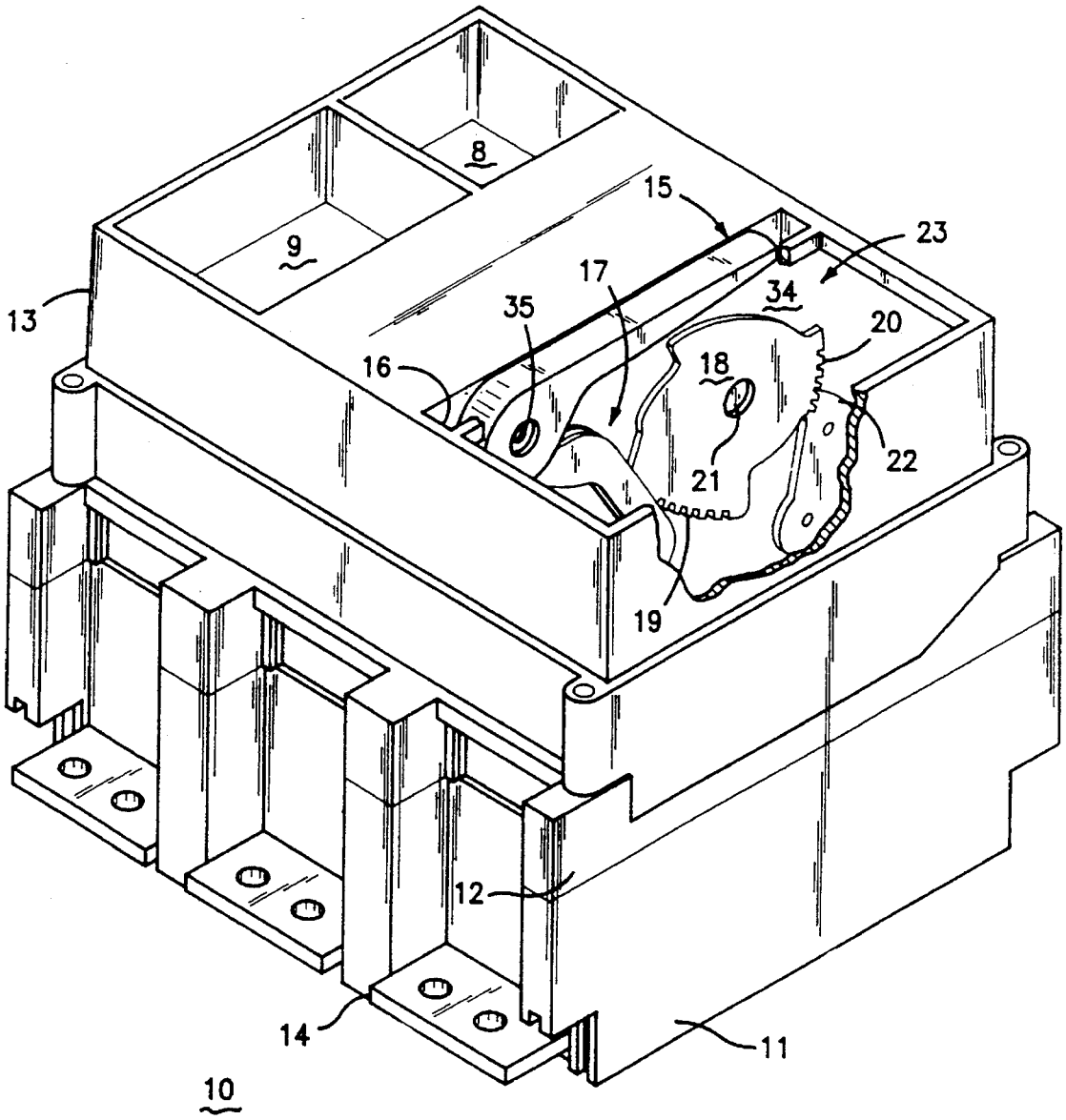
FIG. 1 is a top perspective view of a high ampere-rated circuit breaker with a portion of the circuit breaker cover removed to depict the handle operator unit according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 8 on the top surface of the top cover 13. Although not shown herein, the trip unit is similar to that described within U.S. Pat. No. 2,581,181 and interacts further with an accessory contained within the accessory recess 9 to provide a range of protection and control functions such as described, for example within U.S. Pat. No. 4,801,907. The operating mechanism as described within the aforementioned U.S. patent application Ser. No. 08/203,062 includes a closing shaft 21 which provides the forces required to charge the powerful operating mechanism springs 44 shown in FIG. 4. Referring back to FIG. 1, the operating handle 15 located within the handle recess 16 allows manual operation of the circuit breaker operating mechanism as well as providing manual means for charging the operating mechanism springs through operation of the handle drive assembly 23. The handle 15 is attached to the operating mechanism sideframe 34 by means of the handle pivot pin 35 and is connected with the handle drive gear 18 by a pair of handle drive links 17. The handle drive gear includes a series of handle drive teeth 19 that are driven by the handle drive links and a separate series of handle locking teeth 20 that interact with a locking pawl 22 to restrain the handle drive gear from reverse rotation during the operating spring charging process.

Figure 2:
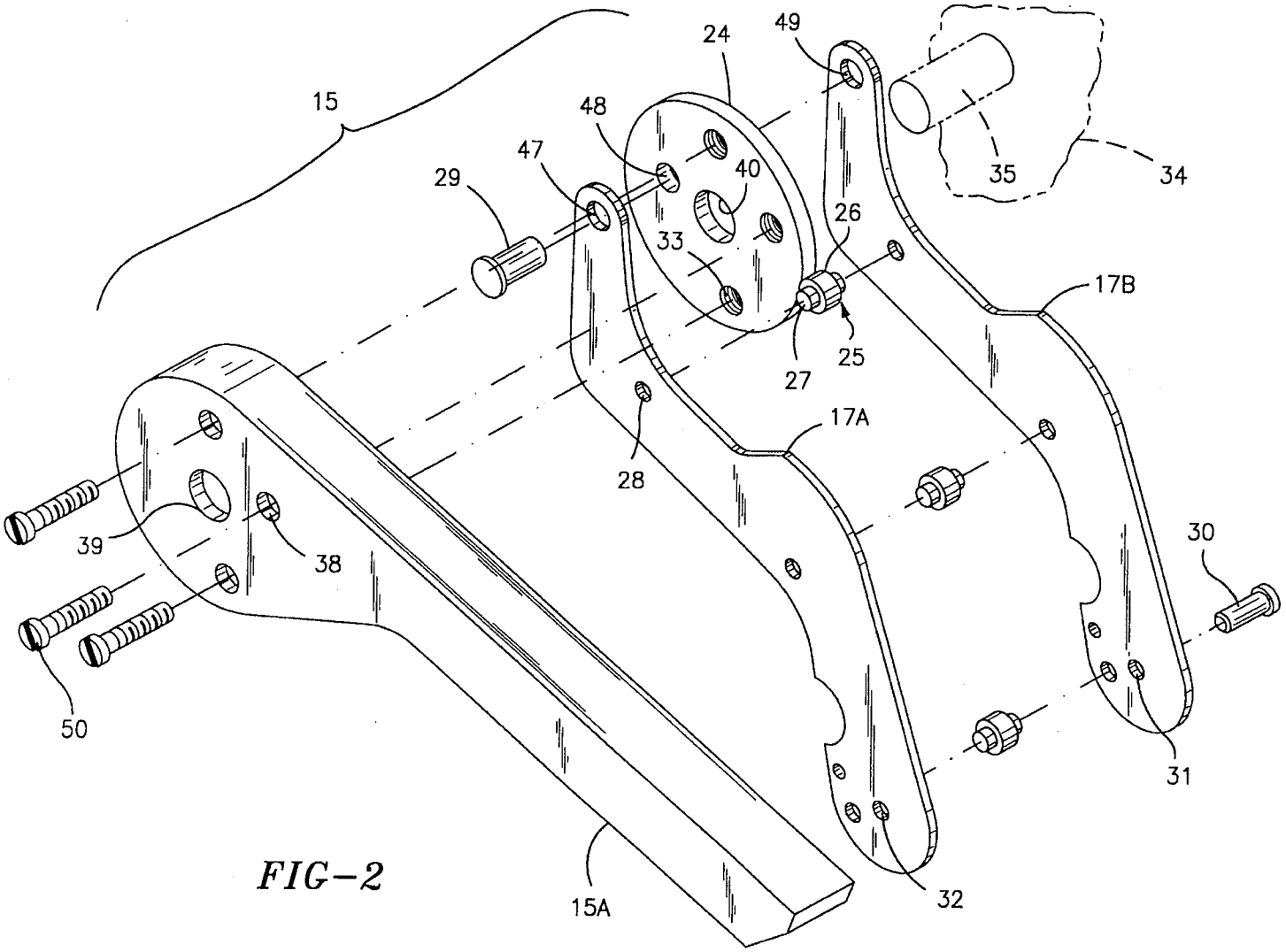
FIG. 2 is an exploded top perspective view of the components within the handle operator unit of FIG. 1.

The handle 15 is assembled in the manner best seen by now referring to FIG. 2 wherein the universal assembly disc 24 and the thru hole 40 is shown relative to the handle pivot post 35 extending from the operating mechanism sideframe, both of which are depicted in phantom. The universal assembly disc is sandwiched between the separate handle drive links 17A, 17B and are accurately spaced apart from each other by means of clearance rivets 25 having a raised central cylinder 26 and a pair of pin connectors 27 extending from opposite sides of the cylinder which are received within corresponding thru holes 28 formed within the handle drive links. A universal disc coupling pin 29 is inserted within the corresponding thru holes 47–49 to tightly retain the universal coupling disc within the handle drive links. A drive pin 30 is inserted within the corresponding thru holes 31, 32 in the handle drive links and interacts with the handle drive gear 18 of FIG. 1 in the manner to be described below in greater detail. When the universal assembly disc is secured to the handle drive links, the handle shaft 15A is fastened to the universal assembly by means of screws 50, thru holes 38 and threaded openings 33. The handle 15 is then mounted on the operating mechanism sideframe 34 by capturing the thru holes 39 and 40 on the pivot pin 35. It is noted that no interior screws, fasteners or rivets are required other than the externally accessible screws 50 during the simplified automated assembly of the handle components.

Figure 3:
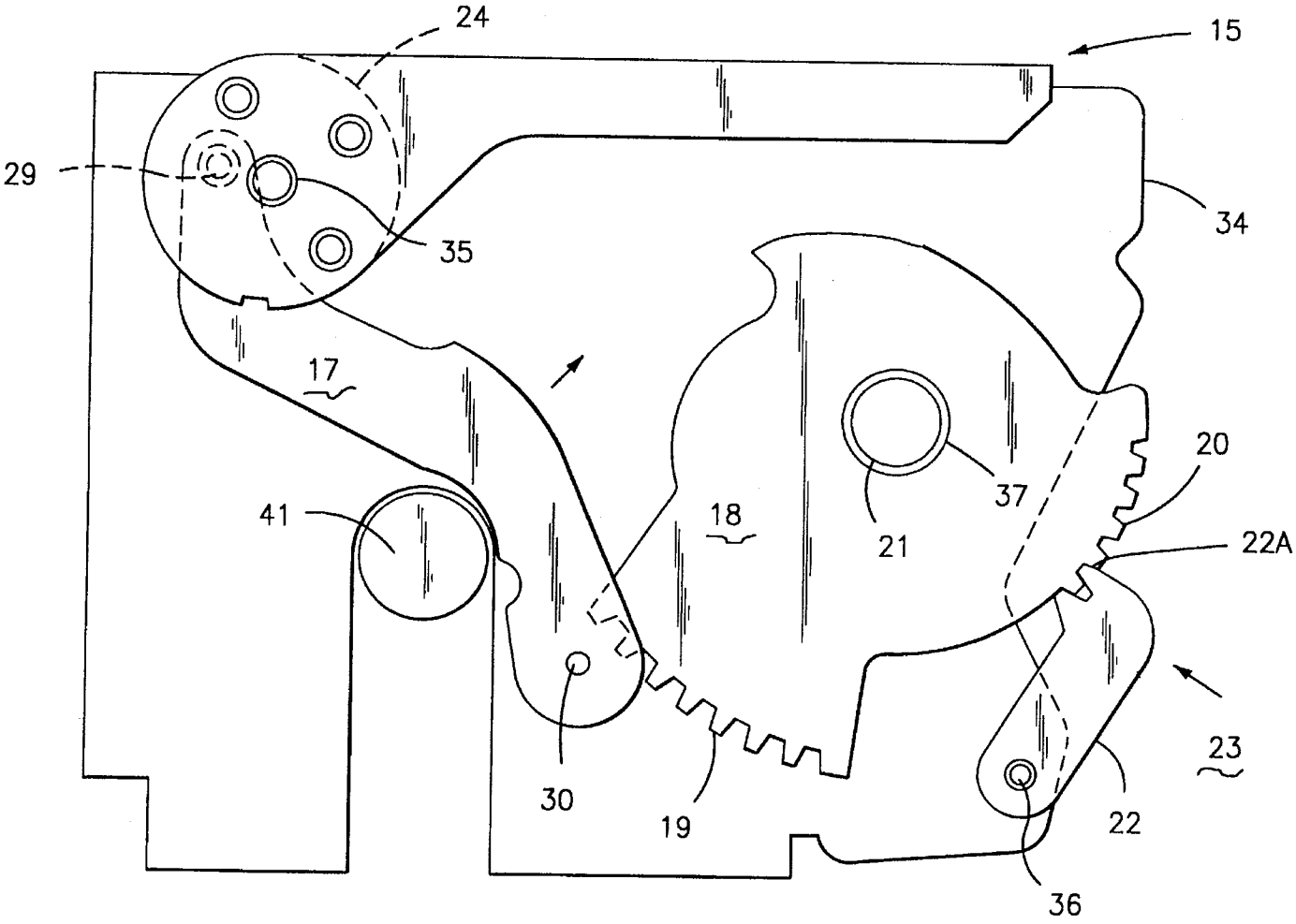
FIG. 3 is a sideview of the handle operator unit of FIG. 2 attached to the circuit breaker operating mechanism sideframe.
Figure 4:
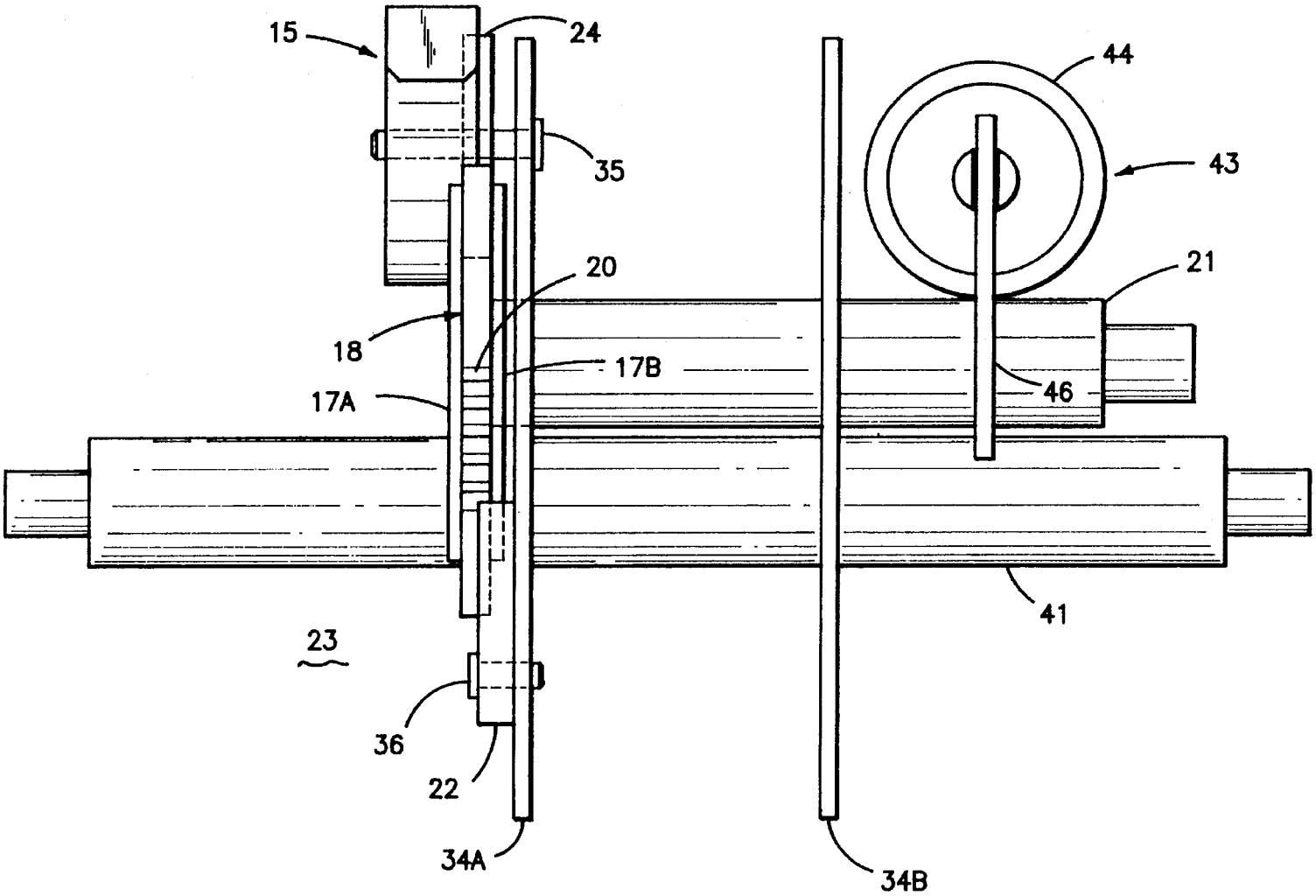
FIG. 4 is a front plan view of the assembled handle operator unit of FIG. 2.

The operation of the handle 15 to charge the operating spring 44 is best seen by referring jointly to FIGS. 3 and 4. The handle 15 is rotated in the counter-clockwise direction as viewed in FIG. 3 about the handle pivot post 35 on the operating mechanism sideframe 34 to charge the operating spring 44. The universal assembly disc 24 rotates and carries the handle drive links 17 in the indicated direction moving the drive pin 30 into engagement with the handle drive teeth 19 to rotate the handle drive gear 18 and the closing shaft 21 which is secured within the opening 37 in the counter-clockwise direction. When handle 15 is rotated further in the counter-clockwise direction the teeth 22A at the end of the locking pawl 22, which is attached to the mechanism side-frame 34 by the locking pawl pivot 36 and biased by a spring (not shown), engage the teeth 20 on the handle drive gear 18 in the handle drive assembly 23 in ratchet-like fashion to prevent the handle drive gear from rotating in the clockwise direction under the reverse bias provided to the closing shaft 21 by the operating spring 44. The operating springs 44 are contained within the operating spring assembly 43 and connect with the closing shaft 21 by means of the crank 46 to supply closing force to the closing shaft, The compact assembly of the handle drive gear 18 between the handle drive links 17A, 17B allows additional components to be connected with the operating mechanism drive shaft 41 without requiring additional space within the operating mechanism sideframes 34A, 34B.

A compact and simplified handle drive assembly for charging circuit breaker operating springs has herein been described. The operating handle components are assembled in a rapid manner without requiring auxiliary fasteners.

We claim:

1. An industrial-rated circuit breaker for high level over-current protection comprising:

an insulative base;

an insulative cover above said base, said cover enclosing a closing shaft and a drive shaft extending between a pair of operating mechanism sideframes;

an operating spring connecting with said closing shaft, said operating spring receiving forces for moving said operating spring into a charged condition;

a handle interacting with said closing shaft, said handle having a pad extending exterior to said cover for allowing an operator to provide said forces;

a handle drive gear intermediate said closing shaft and said handle, said handle drive gear having handle drive teeth interacting with a drive pin and handle locking teeth interacting with a locking paw;

a pair of handle drive links interacting between said handle and said handle drive gear by means of said drive pin engaging said handle drive teeth; and a universal assembly disc connecting between said handle and said drive links by means of a coupling pin.

* * * * *